US005216823A

United States Patent [19]

Ripley

[11] Patent Number: 5,216,823

[45] Date of Patent: Jun. 8, 1993

[54] BEARING AND SEAL ASSEMBLY FOR CLOTHES DRYER DRUM

[75] Inventor: Brian Ripley, Webster City, Iowa

[73] Assignee: White Consolidated Industries, Inc., Cleveland, Ohio

[21] Appl. No.: 852,574

[22] Filed: Mar. 17, 1992

[51] Int. Cl.[5] ..... F26B 11/04

[52] U.S. Cl. ..... 34/133 F; 34/242

[58] Field of Search ..... 34/133 F, 133 R, 133 G, 34/108, 128, 130, 131, 132, 133 P, 133 Q, 242; 384/42, 94, 95

[56] References Cited

U.S. PATENT DOCUMENTS 3,399,464 9/1968 Erickson et al. .

*Primary Examiner*—Henry A. Bennet

*Attorney, Agent, or Firm*—Pearne, Gordon, McCoy & Granger

[57] ABSTRACT

A bearing and seal assembly for rotatably supporting the open front end of the drum of a clothes dryer includes a ring-like felt seal positioned between the circular open front end of the drum and a circular support flange of smaller diameter coaxially nested within the end of the drum. The felt seal is fixed to the flange and substantially fills the annular space between the drum and the flange to preclude air leakage therebetween. A plurality of thin pad-like glides of wear-resistant plastic material are fastened to an upper arcuate portion of the ring-like felt seal, the glides engaging and bearing the weight of the end of the drum. The felt seal positioned between the glides and the support flange acts as a sound dampener and shock absorber between the rotating drum and the fixed flange to preclude undesirable noise caused by rotation of the drum.

5 Claims, 4 Drawing Sheets

BEARING AND SEAL ASSEMBLY FOR CLOTHES DRYER DRUM

BACKGROUND OF THE INVENTION

The present invention relates in general to bearing structures, and more particularly to a bearing and seal assembly for rotatably mounting and supporting an open end of a clothes dryer drum.

A typical clothes dryer of the domestic type includes a clothes containing drum rotatable on a horizontal axis, the drum being contained within a box-like cabinet with a door permitting user access to the drum via its open front end. Such clothes dryer configurations are well known in the art.

While roller type supports beneath the drum can be used to rotatably support it, it is also known to use a ring-like bearing and seal assembly between the open front end of the drum and a circular support flange provided by a front cabinet panel with an access opening that is normally closed by the door.

With reference to U.S. Pat. No. 3,399,464, which is incorporated herein by reference, a ring-like bearing and seal assembly for rotatably supporting the front end of a dryer drum includes a pair of plastic bearing pads 12 that are fixed to an upper portion of a circular support flange 13 extending inwardly from the front panel of the dryer cabinet, the circular flange surrounding the access opening through the front panel. The front end of the drum provides a circular lip 15 that rides on and bears against the two noted bearing pads, the circular support flange being coaxially nested within the open front end of the drum. The annular space between the drum lip and the support flange that is not occupied by the pair of bearing pads is filled with lengths of felt material 15*a* constituting a seal for minimizing air leakage between the lip and the flange.

While such a bearing and seal assembly may adequately provide rotatable support for the front end of the dryer drum, undesirable noise transmission to the dryer cabinet can occur via the bearing pads due to a rotating non-concentric dryer drum as can occur because of drum manufacturing tolerances. Also, the plastic material, such as nylon or polytetrafluoroethylene, used to form the bearing pads is relatively expensive.

Accordingly, it is the primary aim of the present invention to provide a bearing and seal assembly which overcomes each of the aforementioned shortcomings without offsetting disadvantages.

SUMMARY OF THE INVENTION

In accordance with the invention, a ring of felt material is fixed to an inwardly extending circular flange provided by the front panel of a dryer cabinet. A plurality of thin glides of wear-resistant material are fixed to an upper arcuate surface of the felt ring. A circular lip at the open front end of the dryer drum rides on and bears against the glides, the circular flange being coaxially nested within the circular lip of the drum to rotatably support it.

Preferably, most of the felt ring, which functions as an air seal between the drum and the circular flange, is made of relatively low density, low cost felt material. The remaining portion of the felt ring providing the upper arcuate surface carrying the glides is formed of higher density felt material to resist compaction due to the weight of the rotating drum bearing on it. The higher density felt material also acts as a shock absorbing element between the rotating drum and the circular flange supporting it.

The glides are thin to minimize the amount of wear-resistant material needed, and thus reduces the cost of the glides. Preferably, the glides are fastened to the felt ring by heat staking wherein one or more studs extending downwardly from the bottom surface of each glide are received in a corresponding number of apertures extending through the thickness of the felt. The lower distal ends of the studs are then heated or melted to provide enlarged diameter ends that are retained in the apertures in the felt thus locking the glides into position. The melted ends of the studs are recessed relative to the lower surface of the felt wherein the bottom ends of the studs do not contact the circular flange. Such a feature insures that any noise generated by the rotation of a non-concentric drum on the glides is not transmitted directly to the circular flange via the glide mounting studs, and then to the associated dryer cabinet. Rather, the felt ring which is positioned between the rotating drum and the cabinet acts as a sound dampener or attenuator between a rotating, non-concentric drum and its surrounding cabinet.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
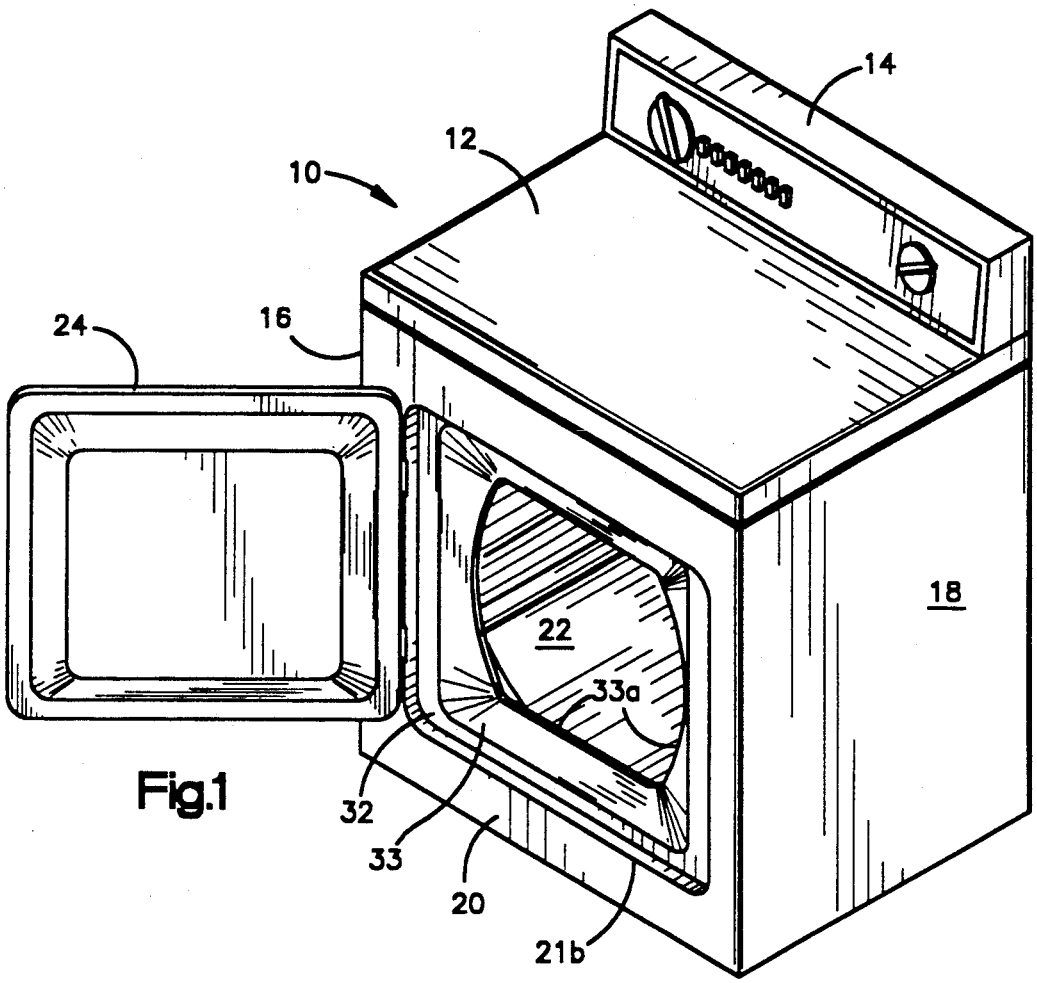
FIG. 1 is a front perspective view of a domestic clothes dryer in an open door condition.

With reference to FIG. 1, a clothes dryer 10 of the domestic type which incorporates the present invention is illustrated. The clothes dryer 10 has a box-like cabinet formed from painted sheet metal as is well known in the art. The dryer 10 includes a horizontal top panel 12 with a control console 14 extending along its rear edge. The control console allows the user to regulate the operation of the clothes dryer to provide drying of clothes placed within the dryer in a predetermined manner. The dryer 10 further includes a pair of vertical side panels 16, 18 and a vertical rear panel (not shown).

A vertical front panel 20 provides an access opening 22 which is normally closed by a door 24 that is hinged along its left edge as shown for movement about a vertical axis. When the door 24 is open as shown in FIG. 1, a user can reach through the access opening 22 and into the interior of the clothes dryer 10 to insert or remove clothing contained therein.

Figure 2:
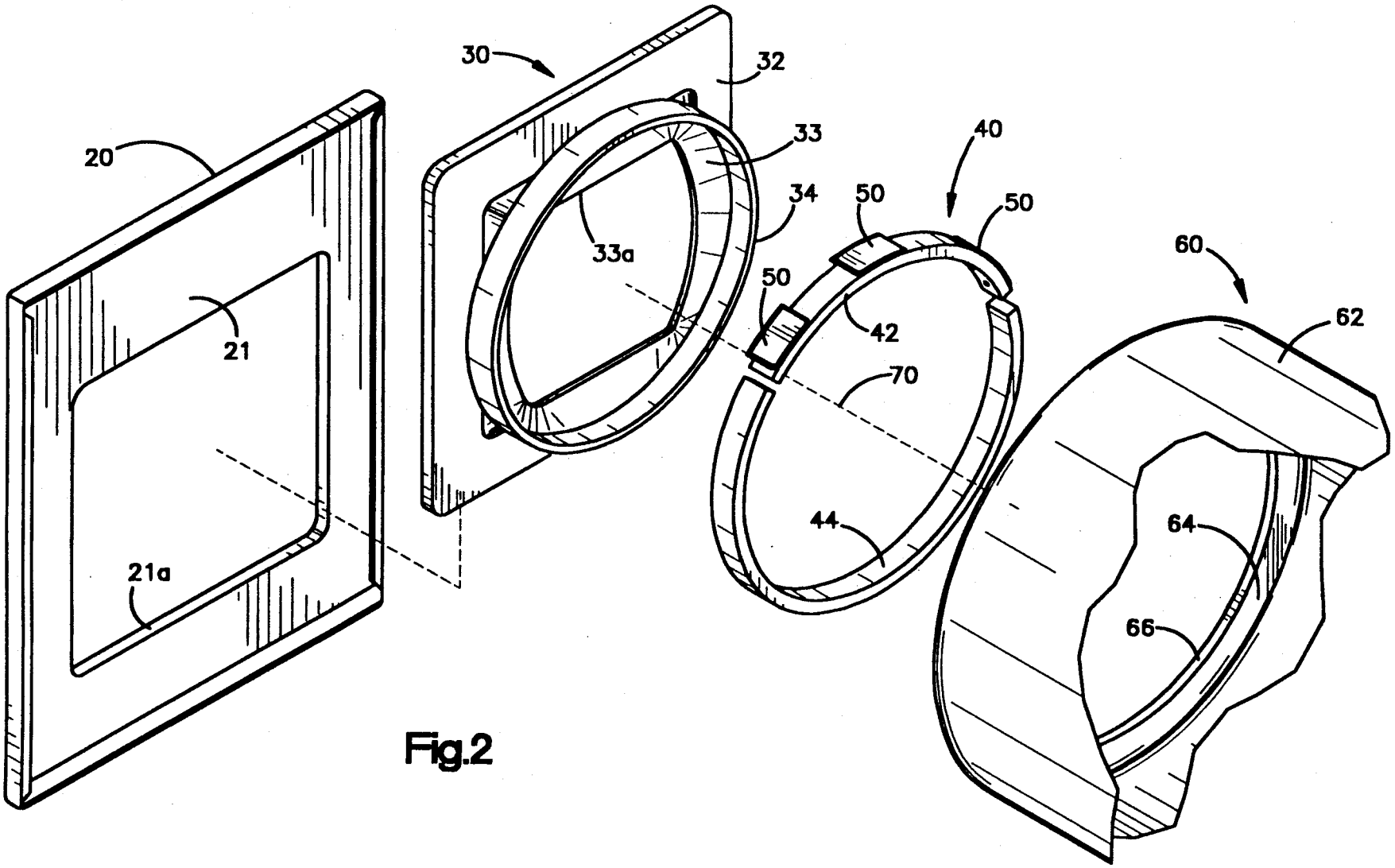
FIG. 2 is a rear exploded perspective view of a front portion of the clothes dryer of FIG. 1 which includes a bearing and seal assembly in accordance with the present invention.

Turning to FIG. 2 of the drawings, the clothes dryer discussed with regard to FIG. 1 can be seen to include in addition to the front panel 20, a drum support panel 30, a bearing and seal assembly 40 in accordance with the present invention and a dryer drum 60 that in operation rotates on a horizontal axis 70.

The front panel 20 provides an inner surface 21 having an inner periphery 21*a* which defines, in part, the access opening 22 (see FIG. 1). The front panel 20 also provides a seat against which the door 24 seals during operation of the dryer 10. A conventional switch (not shown) is provided adjacent the front panel to preclude operation of the dryer without closure of the door 24 against the front panel 20.

The drum support panel 30 has a generally planar, plate-like front portion 32 that is fixed by suitable mechanical means to the inner surface 21 of the front panel 20. Centrally located in the plate-like front portion 32 is an aperture constituting, in part, the access opening 22 (see FIG. 1). With further reference to FIG. 2, the drum support panel 30 includes, in addition to the plate-like front portion 32, a transition ring 33 that is generally annular in shape with a circular outer periphery and a generally rectangular inner periphery 33*a*, as illustrated. The transition ring 33 has extending horizontally from its outer circular periphery a circular drum support flange 34 which is inwardly spaced from the plate-like front portion 32. The transition ring 33 extends inwardly from the plate-like portion 32 to support the circular drum support flange 34 at a relatively inwardly displaced position. When assembled, by welding or suitable mechanical fastening means, the front panel 20 and the drum support panel 30 including its elements 32, 33 and 34 are fixed in position relative to each other and constitute a unitary structure.

The bearing and seal assembly 40 in accordance with the invention, rotatably supports the front end of the dryer drum 60, its rear end (not shown) being supported by conventional means. The assembly 40 includes an upper felt member 42 of a high density felt material and a lower felt member 44 of a felt material having lower density than the upper felt member 42. The high density of the upper felt member 42 helps to prevent compression of the felt member due to the load of the front end of the dryer drum 60. The lower felt member 44 is formed from lower density material because it does not support the load of the dryer drum and, hence, is not susceptible to similar compressive forces.

The felt members 42, 44 combine to provide a ring of felt-like material that is fixed to the circular flange 34 by, for example, a suitable adhesive material. It can be seen that the upper felt member 42 constitutes approximately 25% of the circumferal extent of the ring of felt-like material while the lower felt member 44 constitutes approximately 75% thereof. The combination of high density and low density felt in this manner provides low cost drum support and air seal, as the amount of high density felt, which is relatively more expensive than the low density felt, is reduced. Naturally, if product expense is no consideration, the entire ring could be formed of high density material. The higher density upper felt member 42 carries upon its top surface, a plurality of thin pad-like glides 50 of wear-resistant material that are fixed to the outer surface of the ring of felt-like material in a manner to be more fully illustrated subsequently.

Figure 3:
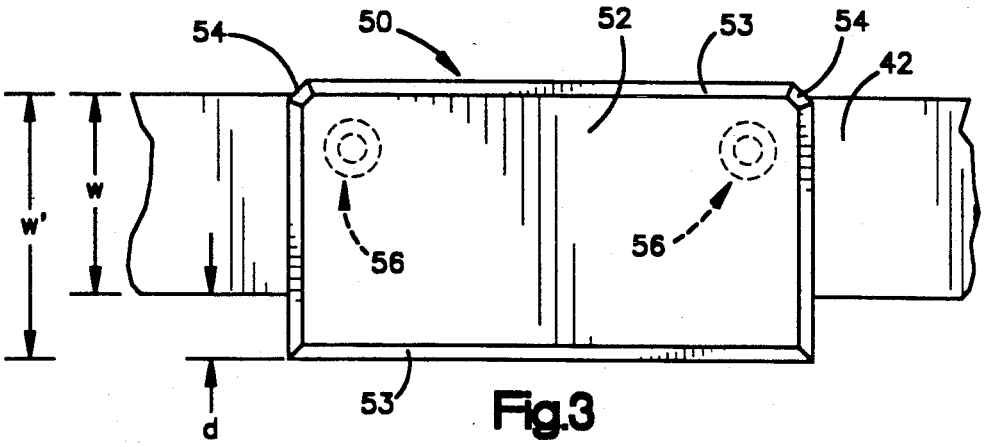
FIG. 3 is a top plan view of a glide member portion of the bearing and seal assembly illustrated in FIG. 2.

With reference to FIG. 3, each glide 50 is of generally rectangular shape with a top surface 52 having beveled edges 53. The rearwardmost beveled edge 53 extends between a pair of truncated rear corners 54. Truncation of the rear corners 54 insures that clothing rotating within the drum 60 (see FIG. 2) will not snag on the blunted corners 54. With further reference to FIG. 3, the upper felt member 42 has a width W which is less than the width W' of the glide 50, as illustrated. Thus, the glide extends past and overhangs the upper felt member 42 by a distance d for purposes to be subsequently discussed with regard to FIGS. 4 and 5.

Figure 4:
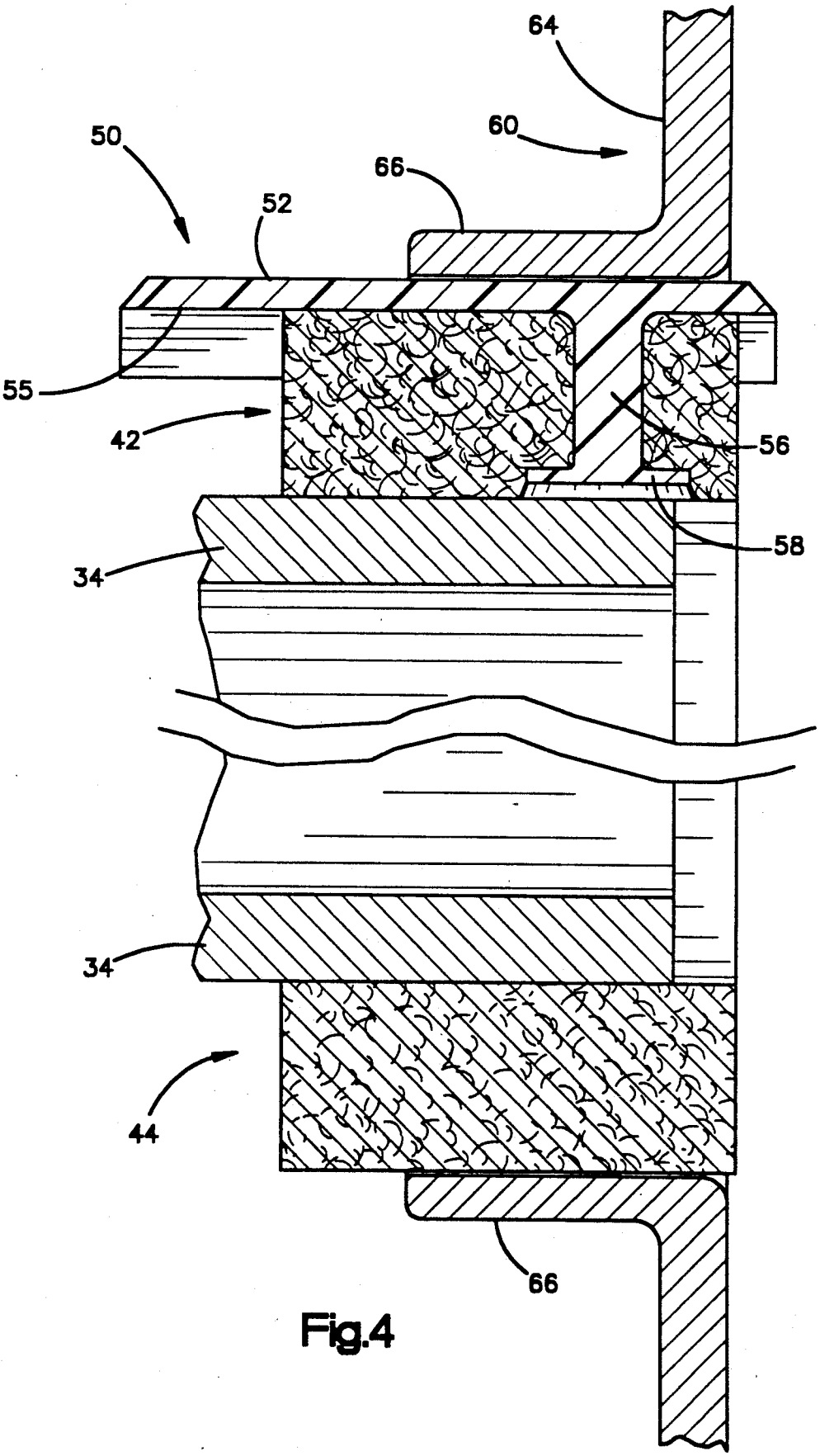
FIG. 4 is a side cross sectional elevation view of the bearing and seal assembly of the invention in its normal position relative to other elements of the clothes dryer with portions cut away.

As shown in FIG. 3, the glide 52 further includes a pair of studs 56 that are used to mechanically attach the glide 50 to the upper felt member 42. Turning to FIG. 4, the upper and lower felt members 42, 44 are shown in their mounted position on the outer surface of the circular drum support flange 34. It can be seen that the felt members 42, 44 have a generally rectangular cross section, with their width being greater than their thickness. The felt member 42 is of a density greater than the felt member 44. Each of the glides 50 includes a pair of studs 56 that extend downwardly from the lower surface 55 of the glide 50 into an aperture within the upper felt member 42. The bottom end of each stud 56 is heated or melted to provide an enlarged bottom surface 58 that retains the stud 56 within the aperture in the felt and thus anchors the glide 50 thereto. The enlarged bottom end 58 positively prevents removal of the glide 50 so installed within the upper felt member 42 absent a substantial upward force, generally in excess of 25 lbs. It is to be noted that in accordance with the present invention, the enlarged bottom end 58 of the stud 56 located within the interior of the upper felt member or, in other words, are recessed below the bottom surface of the upper felt member 42 so as not to be in contact with the drum support flange as illustrated. As can be seen, the annular front wall 64 of the dryer drum provides at its inner periphery, a horizontally extending circular lip 66 that rides upon the glides 50. The glides 50 are preferably formed of a wear-resistant material such as polytetrafluoroethylene or the like. Such a material provides a low friction interface between the moving circular lip 66 and the fixed glides 50. As is known in the art, due to manufacturing tolerances, the circular lip 66 will not be perfectly concentric. Thus, as the drum 60 rotates, vibration and resultant noise can be generated. To minimize the transmission of such undesirable vibratory induced noise to the outer cabinet of the dryer, the upper felt and lower felt members 42, 44 act as a sound attenuator and shock absorber positioned between the lip 66 and the drum support flange 34. Since the lower enlarged ends 58 of the glides 50 are not in contact with the drum support flange 34, they cannot function as a conduit for sound transmission.

With further reference to FIG. 4, it can be seen that the smaller diameter circular flange 34 is coaxially nested within the larger diameter circular lip 66 of the drum 60. The annular space between the flange and the lip is substantially filled primarily by the felt-like material constituted by felt members 42, 44 so as to establish an air seal therebetween. The pad-like glides 50 are relatively thin as compared to the thickness of the associated upper felt member 42 so as to reduce the amount of wear-resistant glide material thus reducing costs.

Figure 5:
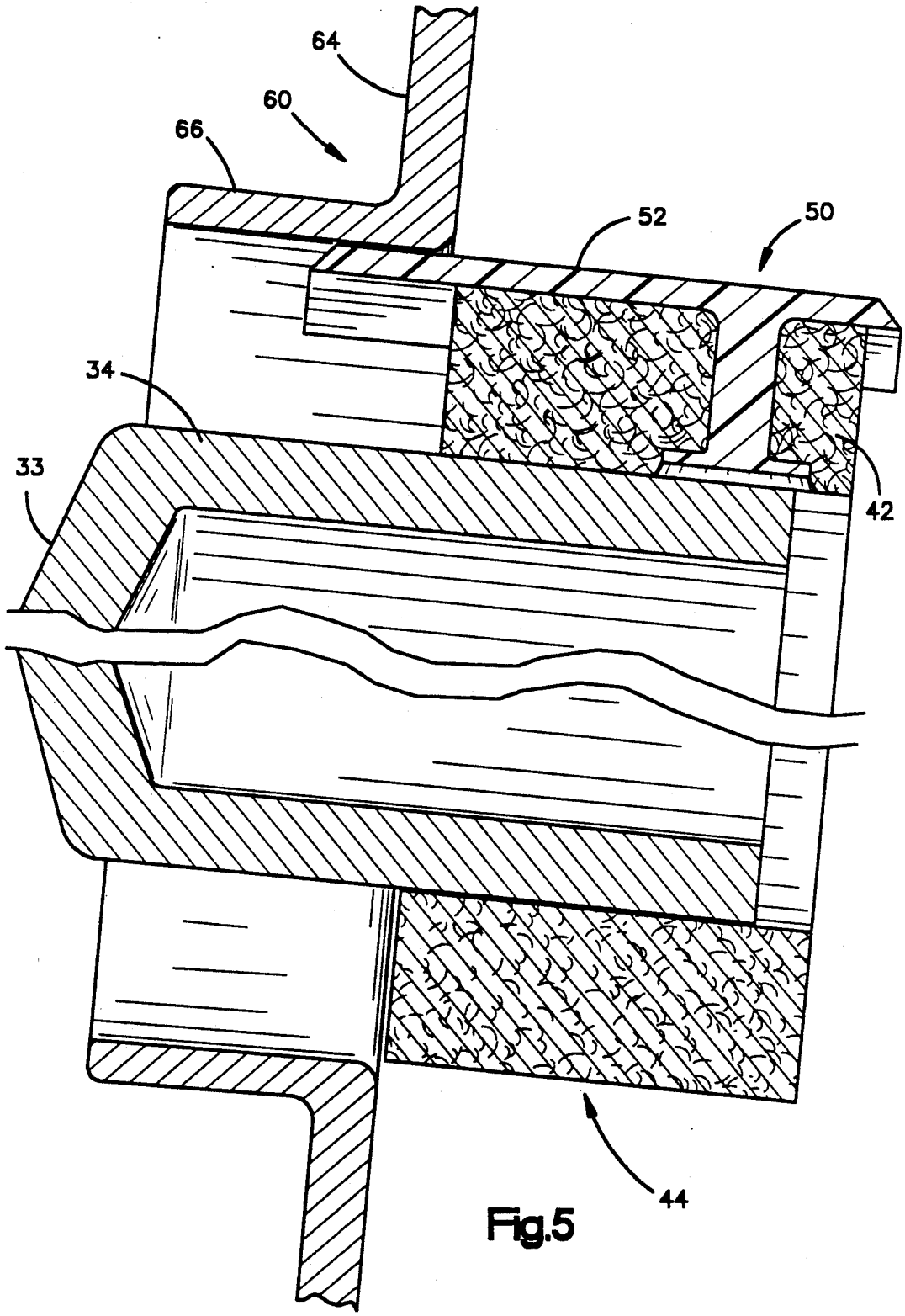
FIG. 5 illustrates an abnormal condition between elements of the clothes dryer that can occur for example, during shipping and transportation of the clothes dryer.

Further reference to FIG. 4, the drum 60 with its associated circular lip 66, the glides 50, the felt members 42, 44 and the circular flange 34 are shown in their normal positions when the dryer drum is rotating. With reference to FIG. 5, an abnormal condition that may result during shipping and transportation of the dryer when not operating is illustrated. As can be seen, the dryer drum 60 has shifted forwardly toward the front panel 20 (see FIG. 1) of the clothes dryer. This can occur during shipping and transportation of the dryer due to manufacturing tolerances. When the clothes dryer is installed and is operating, the drum 60 will assume its normal position during rotation as illustrated in FIG. 4. When the dryer drum 60 is at its abnormal position illustrated in FIG. 5, the extended front edge of the glide 50 precludes the drum 60 from moving downwardly or in effect, falling off of the upper felt member 42. Thus, the glide not only serves as a rotatable wear-resistant support for the rotating front end of the drum 60, but also as, in effect, a stop to preclude downward movement of the drum 60 when in the position shown in FIG. 5. The forward extension of the glides 50 allows less felt material to be used since the upper felt member 42 does not have to extend leftwardly as shown in FIG. 5 so as to underlie the flange 66 when in its abnormal position as illustrated.

As can be seen from the above, a simple, low-cost dryer drum bearing and seal assembly has been provided. A lower density, reduced cost, lower felt member 44 which functions primarily as an air seal member between the drum 60 and the support flange 34 constitutes a major portion i.e., approximately 75% of the ring-like felt material between the drum 60 and the flange 34. An upper felt member 42 of high density material that can bear the weight of the front end of the drum 60 is carried on the upper end of the flange 34. This higher density material supports on its upper surface, the glides 50 which are mechanically fixed thereto in a manner that precludes sound transmission from the glides to the flange 34. The glides also serve by the extension of their forward ends as stop means to preclude downward movement of the front end of the drum 60 as may occur during vertical misalignment caused by shipping and installation of the dryer.

It should be evident that this disclose is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A bearing and seal assembly for rotatably supporting an end of a rotatable dryer drum located within a cabinet and rotatable on a horizontal axis comprising:

a circular flange supported by and fixed to the cabinet; the end of said rotatable dryer drum providing a circular lip;

a ring of felt-like material fixed to said circular flange, said circular flange and said circular lip being coaxially nested within each other, the annular space between said flange and said lip being substantially filled by said ring of felt-like material to establish an air seal therebetween, said circular lip being rotatable relative to said flange; and at least one pad-like glide of wear-resistant material fixed to an outer surface of the ring of felt-like material, said glide being interposed between the ring and the circular lip, the lip engaging and bearing on the glide, the glide being isolated from the circular flange by the ring of felt-like material, wherein said glide is mechanically fixed to said ring by at least one stud projecting from said glide, said stud being anchored within said felt-like material forming said ring, said stud being in non-contacting relationship with said circular flange to minimize noise transmission to said flange by said stud.

2. A bearing and seal assembly for rotatably supporting an end of a rotatable dryer drum located within a cabinet and rotatable on a horizontal axis comprising:

a circular flange supported by and fixed to the cabinet, the end of said rotatable dryer drum providing a circular lip;

a felt ring fixed to said circular flange, said circular flange being coaxially nested within said lip, wherein said lip, said ring, and said flange are generally vertically aligned during rotation of said drum, the annular space between said flange and said lip being substantially filled by said felt ring to establish an air seal therebetween, said circular lip being rotatable relative to said flange; and a plurality of pad-like glides of wear-resistant plastic material fixed to the outer surface of an upper arcuate portion of the felt ring, said glides being interposed between the ring and the circular lip, the lip engaging and bearing on the glides, the glides being isolated from the circular flange by the felt ring, wherein said felt ring is formed of felt material of rectangular cross section, said rectangular cross section material having a bottom surface adhered to said flange, a top surface supporting said glides, a front side adjacent said cabinet and a rear side spaced from said front side, the distance between said front and rear sides defining the width of said felt material, the distance between said top and bottom surfaces defining the thickness of said felt material forming said ring.

3. An assembly according to claim 2 wherein said upper arcuate portion of said felt ring is formed of felt material having a density greater than the density of remaining portions of said felt ring, said greater density material functioning as a shock absorber between said rotatable drum and said cabinet.

4. An assembly according to claim 2 wherein said glides are thin as compared to the thickness of said felt material, said glides each having a rectangular shape with a length extending along the length of the felt material, and a width extending across the said width of the felt material, each glide having a top surface engageable with said lip and a bottom surface fixed relative to and in contact with the said top surface of the felt material.

5. An assembly according to claim 4 wherein the width of the glides is greater than the said width of the felt material to allow said lip to maintain engagement with said glides should said generally vertically aligned felt ring and circular lip become vertically misaligned.

* * * * *